US006666117B2

(12) United States Patent
Hu

(10) Patent No.: US 6,666,117 B2
(45) **Date of Patent: *Dec. 23, 2003**

(54) WRENCH WITH A FIXED MAXIMUM OPERATIONAL TORQUE

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 47 days.

This patent is subject to a terminal disclaimer.

(21) Appl. No.: 09/978,517

(22) Filed: Oct. 15, 2001

(65) Prior Publication Data

US 2003/0010162 A1 Jan. 16, 2003

(30) Foreign Application Priority Data

Jul. 13, 2001 (TW) ..... 90212016 U

(51) Int. Cl.[7] ..... B25B 23/14

(52) U.S. Cl. ..... 81/467; 81/478; 81/480; 464/35; 464/37

(58) Field of Search ..... 81/467, 478, 480, 81/481, 483; 464/35, 37, 41

(56) References Cited

U.S. PATENT DOCUMENTS

| | | | | |
|---|---|---|---|---|
| 15,482 A | | 8/1856 | Gilman | |
| 810,599 A | | 1/1906 | Ansorge | |
| 841,686 A | | 1/1907 | Hatfield | |
| 893,097 A | | 7/1908 | Reams | |
| 915,446 A | | 3/1909 | Kearnes | |
| 1,033,358 A | | 7/1912 | Turner | |
| 1,194,471 A | | 8/1916 | Boosinger | |
| 1,261,092 A | | 4/1918 | Allen | |
| 1,382,492 A | | 6/1921 | Evans | |
| 1,426,127 A | | 8/1922 | Tuttle | |
| 1,614,039 A | | 1/1927 | Mandl | |
| 1,957,462 A | | 5/1934 | Kress | |
| 2,157,574 A | * | 5/1939 | Siesel | 464/35 |
| 2,193,984 A | | 3/1940 | Rhinevault | |
| 2,201,705 A | | 5/1940 | Stone | |
| 2,201,827 A | | 5/1940 | Froeschl et al. | |
| 2,300,652 A | * | 11/1942 | Cooney | 81/483 |
| 2,317,461 A | | 4/1943 | Jackson | |
| 2,332,971 A | * | 10/1943 | Johnson | 81/480 |
| 2,396,027 A | * | 3/1946 | Spayd | 81/480 |
| 2,542,241 A | | 2/1951 | Fors | |
| 2,601,044 A | * | 6/1952 | Mayer | 81/480 |
| 2,657,604 A | | 11/1953 | Rueb | |
| 2,701,977 A | | 2/1955 | Stone | |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

OTHER PUBLICATIONS

Tool and Manufacturing Engineers Handbook, 1976, 3rd Edition, pp. 6–48.

*Primary Examiner*—James G. Smith
(74) *Attorney, Agent, or Firm*—Alan D. Kamrath; Rider Bennett, LLP

(57) ABSTRACT

A wrench comprises a rod comprising a driving portion for engaging with a fastener, a retainer having an end securely engaged with the rod to move therewith, and a casing comprising a compartment for accommodating the retainer. The casing comprises a retaining section defining a retaining space for retaining the other end of the retainer in place. When a rotational force applied to the casing is smaller than an engaging force between the retaining section of the casing and a retaining device that is attached between the retaining section and the retainer, the retainer and the rod are turned to thereby turn the fastener. When a rotational force applied to the casing is greater than the engaging force, the casing slides while the retainer and the rod are not turned.

20 Claims, 11 Drawing Sheets

U.S. PATENT DOCUMENTS 2,764,048 A 9/1956 Thompson
2,768,547 A * 10/1956 Noell ..... 81/480
2,769,360 A 11/1956 Cottrell et al.
2,800,821 A 7/1957 Fruscella
2,826,107 A * 3/1958 Woods ..... 81/480
2,891,434 A 6/1959 Lozensky
2,957,377 A 10/1960 Hare
2,972,271 A * 2/1961 Gill ..... 81/480
2,978,081 A 4/1961 Lundin
3,019,682 A 2/1962 Hare
3,250,157 A 5/1966 Badger
3,265,171 A 8/1966 Kilness
3,337,014 A 8/1967 Sandrick
3,393,587 A 7/1968 Jolliff et al.
3,393,780 A 7/1968 Kilness
3,436,992 A 4/1969 Over et al.
3,577,816 A 5/1971 Alexander et al.
3,593,542 A * 7/1971 Urayama ..... 464/37
3,651,718 A * 3/1972 Thomasian ..... 81/480
3,713,356 A 1/1973 Knudsen
3,742,788 A 7/1973 Priest
3,838,614 A 10/1974 O'Donnell
3,908,487 A 9/1975 Plaw
4,070,932 A 1/1978 Jeannotte
4,111,077 A 9/1978 Cummings et al.
4,128,025 A 12/1978 Main et al.
4,238,978 A * 12/1980 Leone ..... 81/480
4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Deibert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,807,500 A 2/1989 Main
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella
5,144,869 A 9/1992 Chow
5,152,200 A * 10/1992 Kaplan ..... 81/467
5,157,994 A 10/1992 Krivec
5,178,047 A 1/1993 Arnold et al.
5,199,330 A 4/1993 Arnold et al.
5,199,335 A 4/1993 Arnold et al.
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,495,783 A 3/1996 Slusar et al.
5,499,560 A 3/1996 Aeschliman
5,501,124 A 3/1996 Ashby
5,509,333 A 4/1996 Rion
5,533,427 A 7/1996 Chow
5,557,994 A 9/1996 Nakayama
5,582,081 A 12/1996 Lin
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
5,829,326 A 11/1998 Richner
5,842,391 A 12/1998 Chaconas
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A 12/2000 Chen
6,205,889 B1 3/2001 Hsieh
6,209,423 B1 4/2001 Shiao
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,282,993 B1 9/2001 Forman et al.
6,301,998 B1 10/2001 Hu
6,431,031 B1 8/2002 Hu
6,435,062 B1 8/2002 McCann
6,435,063 B1 8/2002 Chen
6,439,086 B1 * 8/2002 Bahr ..... 81/467
6,450,066 B1 9/2002 Hu
6,450,068 B1 9/2002 Hu
6,453,779 B2 9/2002 Hu
6,457,387 B1 10/2002 Hu
6,457,389 B1 10/2002 Hu
6,488,136 B2 12/2002 Chang
2001/0035074 A1 11/2001 Hu
2002/0017169 A1 2/2002 Hu
2002/0023519 A1 2/2002 Hu
2002/0023520 A1 2/2002 Hu 2002/0026858 A1 3/2002 Hu
2002/0062718 A1 5/2002 Wang
2002/0088312 A1 7/2002 Ling et al.
2002/0112573 A1 8/2002 Hu
2002/0162423 A1 11/2002 Hu
2002/0162424 A1 11/2002 Hu
2002/0166416 A1 11/2002 Hu
2002/0166417 A1 11/2002 Hu
2002/0194950 A1 12/2002 Hu

* cited by examiner

A-A

B–B

B–B

B–B

WRENCH WITH A FIXED MAXIMUM OPERATIONAL TORQUE

BACKGROUND OF THE INVENTION

1. Field of the Invention

The present invention relates to a wrench with a fixed maximum operational torque to prevent damage to the object secured by a fastener driven by the wrench.

2. Description of the Related Art

FIG. 10A of the drawings illustrates a conventional wrench 1 having a hexagonal driving portion with six planar faces for engaging with six faces of a hexagonal groove in a top face of a fastener. However, slide tends to occur between the planar faces of the driving portion of the wrench 1 and the faces of the fastener. FIG. 10B illustrates a so-called TORX wrench 3 having plural arcuate faces for engaging with corresponding arcuate faces in a top face of a fastener. Such a TORX wrench 3 is used to tighten important parts of a car and cutting tools. As illustrated in FIG. 11, a blade 7 is tightened to a cutting tool 5 by a bolt 6. However, it was found that the expensive blade 7 tends to be damaged when the bolt 6 is excessively tightened. However, the blade 7 could fly away and thus cause injury if the bolt 6 is not tightened to the desired extent.

SUMMARY OF THE INVENTION

An object of the present invention is to provide a wrench with a fixed maximum operational torque such that when the torque applied by the user is greater than the maximum operational torque, the wrench slides and the fastener is not turned. Thus, damage to the object secured by the fastener is prevented.

Another object of the present invention is to provide a wrench with a fixed maximum operational torque that can be altered in response to the actual use.

A wrench comprises a rod comprising a driving portion for engaging with a fastener, a retainer having an end securely engaged with the rod to move therewith, and a casing comprising a compartment for accommodating the retainer. The casing comprises a retaining section defining a retaining space for retaining the other end of the retainer in place. When a rotational force applied to the casing is smaller than an engaging force between the retaining section of the casing and a retaining device that is attached between the retaining section and the retainer, the retainer and the rod are turned to thereby turn the fastener. When a rotational force applied to the casing is greater than the engaging force, the casing slides while the retainer and the rod are not turned.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
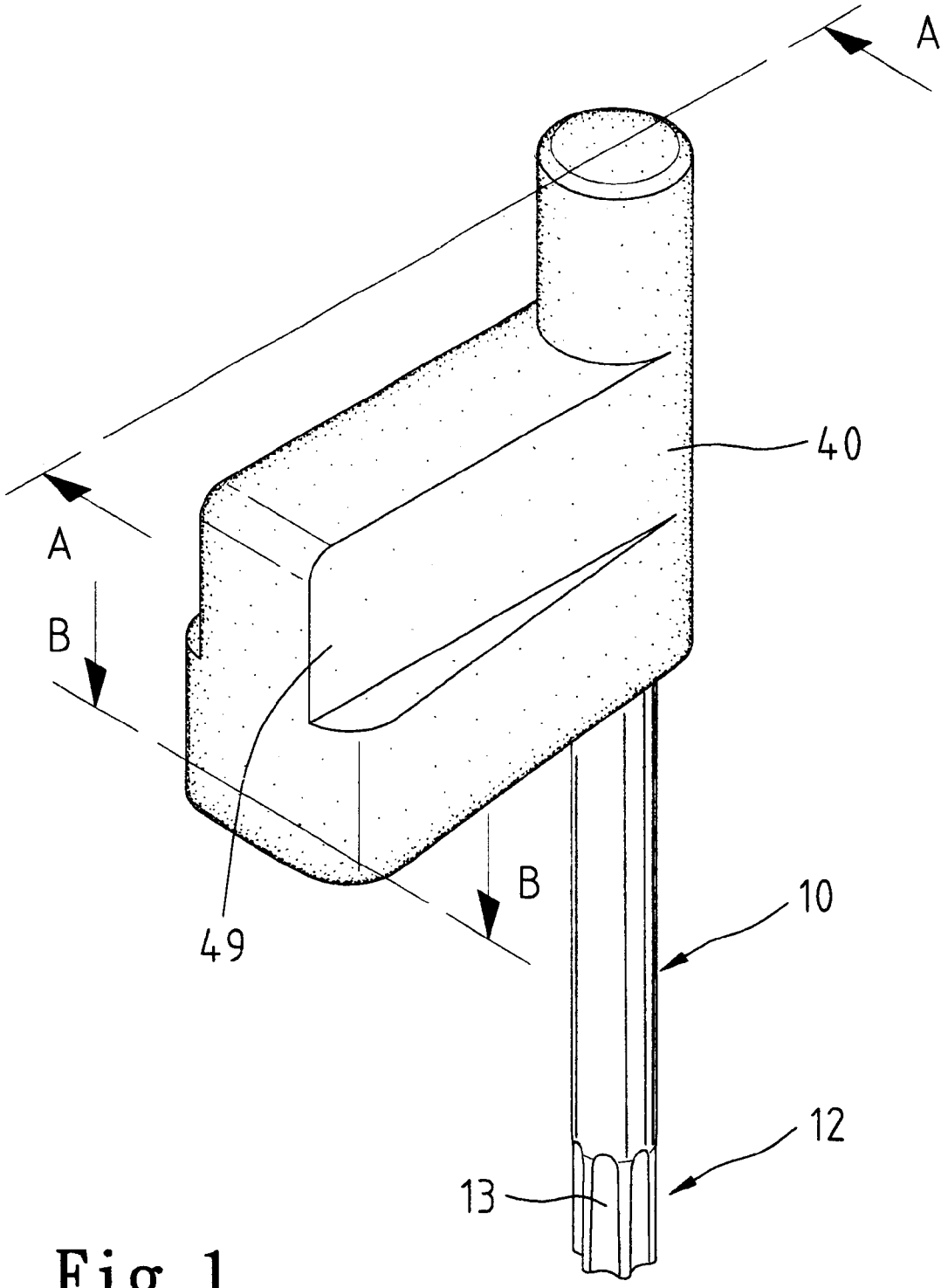
FIG. 1 is a perspective view of a wrench in accordance with the present invention.
Figure 2:
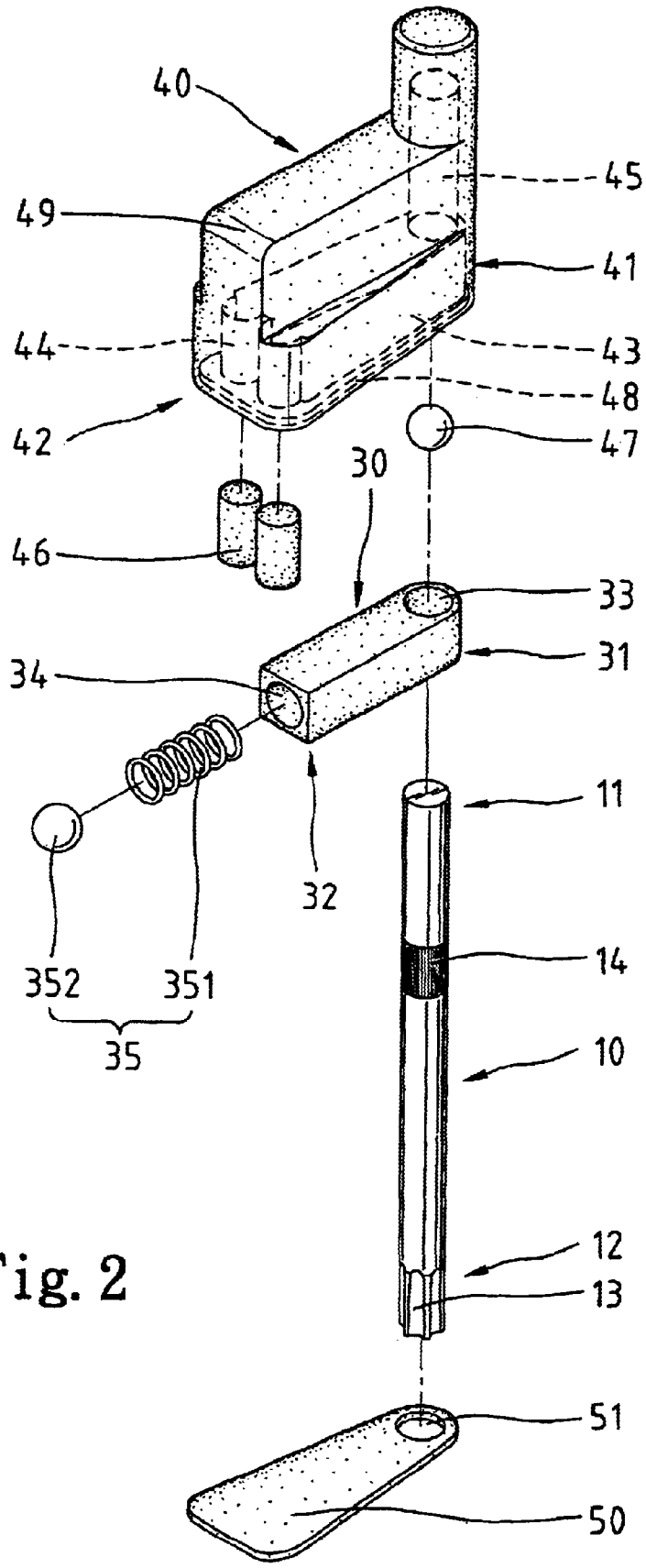
FIG. 2 is an exploded perspective view of the wrench in accordance with the present invention.

Referring to FIGS. 1 and 2, a wrench in accordance with the present invention generally includes a rod 10, a retainer 30, and a casing 40. The rod 10 comprises a first end 11 and a second end 12 with a driving portion 13 for engaging with a fastener. In this embodiment, the driving portion 13 is shaped as a TROX type wrench. The rod 10 further has an embossed section 14 adjacent to the first end 11 thereof.

The retainer 30 comprises a first end 31 and a second end 32. A transverse through-hole 33 is defined in the first end 31 of the retainer 30 and securely engages with the embossed section 14 of the rod 10 to move therewith. A receptacle 34 is defined in an end face of the second end 32 of the retainer 30 for receiving a retaining means 35 comprised of an elastic element 351 and a ball 352.

Figure 5:
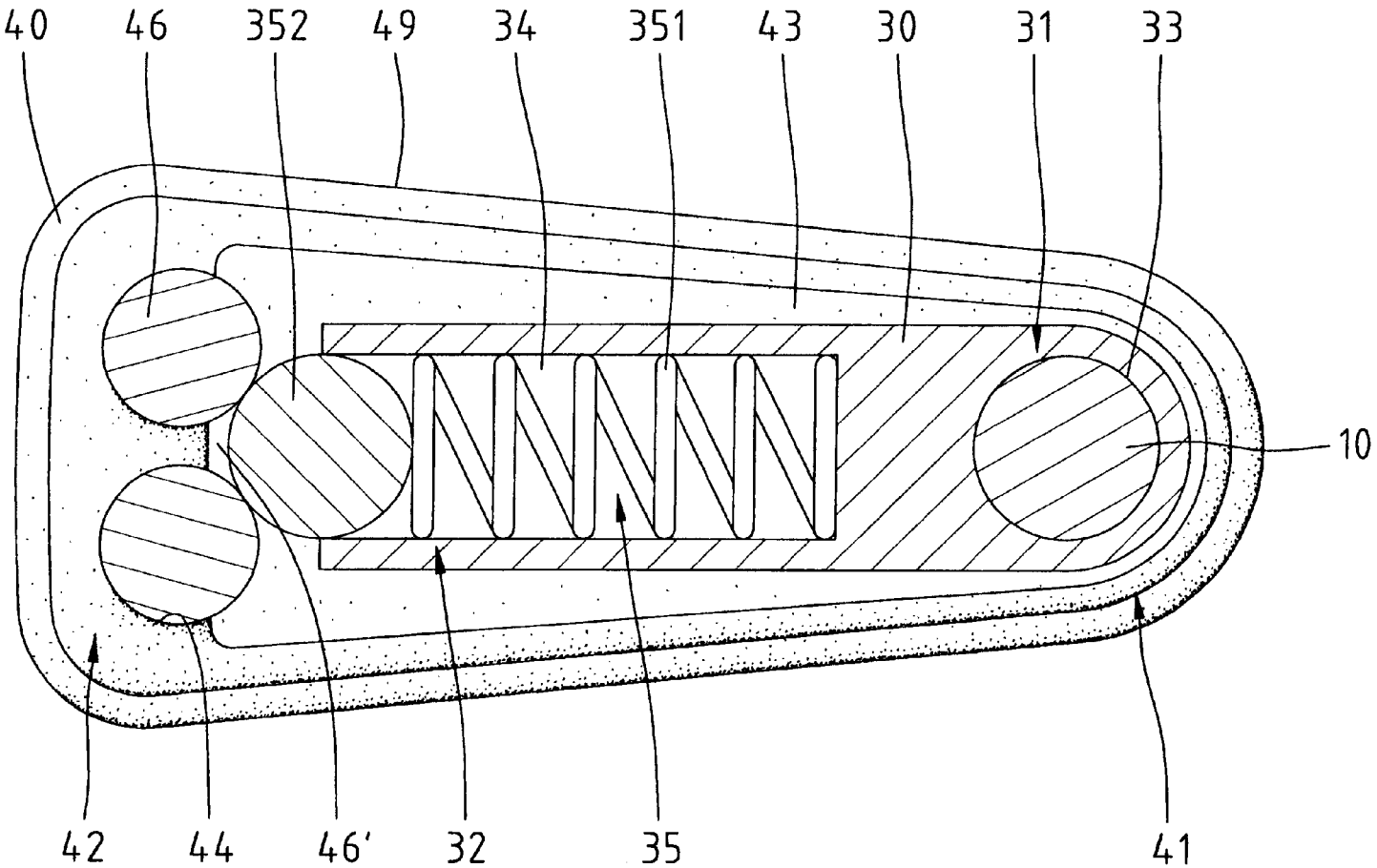
FIG. 5 is a sectional view taken along plane B—B in FIG. 1.

The casing 40 comprises a first end 41 and a second end 42. A grip portion 49 is formed on the second end 42 of the casing 40 for manual turning operation. A compartment 43 is defined in the casing 40 for accommodating the retainer 30. As illustrated in FIGS. 2 and 5, a wall defining a portion of the compartment 43 and facing the retainer 30 comprises two peg holes 44 each having an opening (not labeled) communicated with the compartment 43. A steel peg 46 is anchored in each peg hole 44. As illustrated in FIG. 5, a portion not greater than a half of each steel peg 46 is exposed in the compartment 43. And a retaining space 46' is defined between the exposed portions of the steel pegs 46 that forms a retaining section. Normally, the ball 352 is biased by the elastic element 351 to enter and thus be retained in the retaining space 46'. In this embodiment, the ball 352 presses against the exposed portions of the steel pegs 46 under the action of the elastic element 351.

Figure 3:
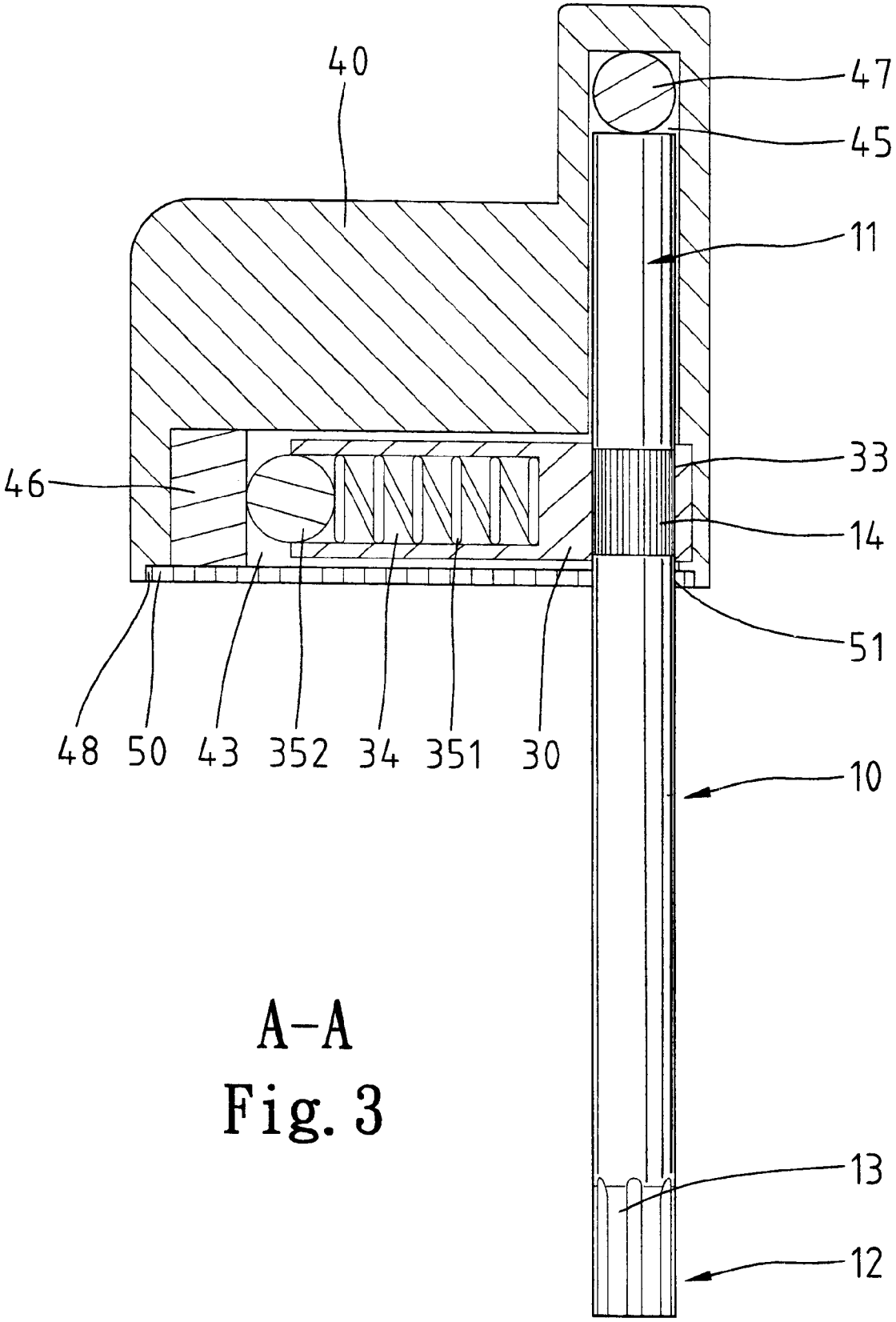
FIG. 3 is a sectional view taken along plane A—A in FIG. 1.

Referring to FIG. 3, a positioning hole 45 is defined in the first end 41 of the casing 40 and communicated with the compartment 43. The first end 11 of the rod 10 is received in the positioning hole 45 of the casing 40, and a ball 47 is provided between an end face of the first end 11 of the rod 10 and an end wall defining a portion of the positioning hole 45 of the casing 40 to provide a smooth rotation therebetween. A recessed portion 48 surrounds the compartment 43 of the casing 40, and a lid 50 is mounted in the recessed portion 48 for enclosing the compartment 43. The lid 50 has a hole 51 through which the rod 10 extends.

Figure 4:
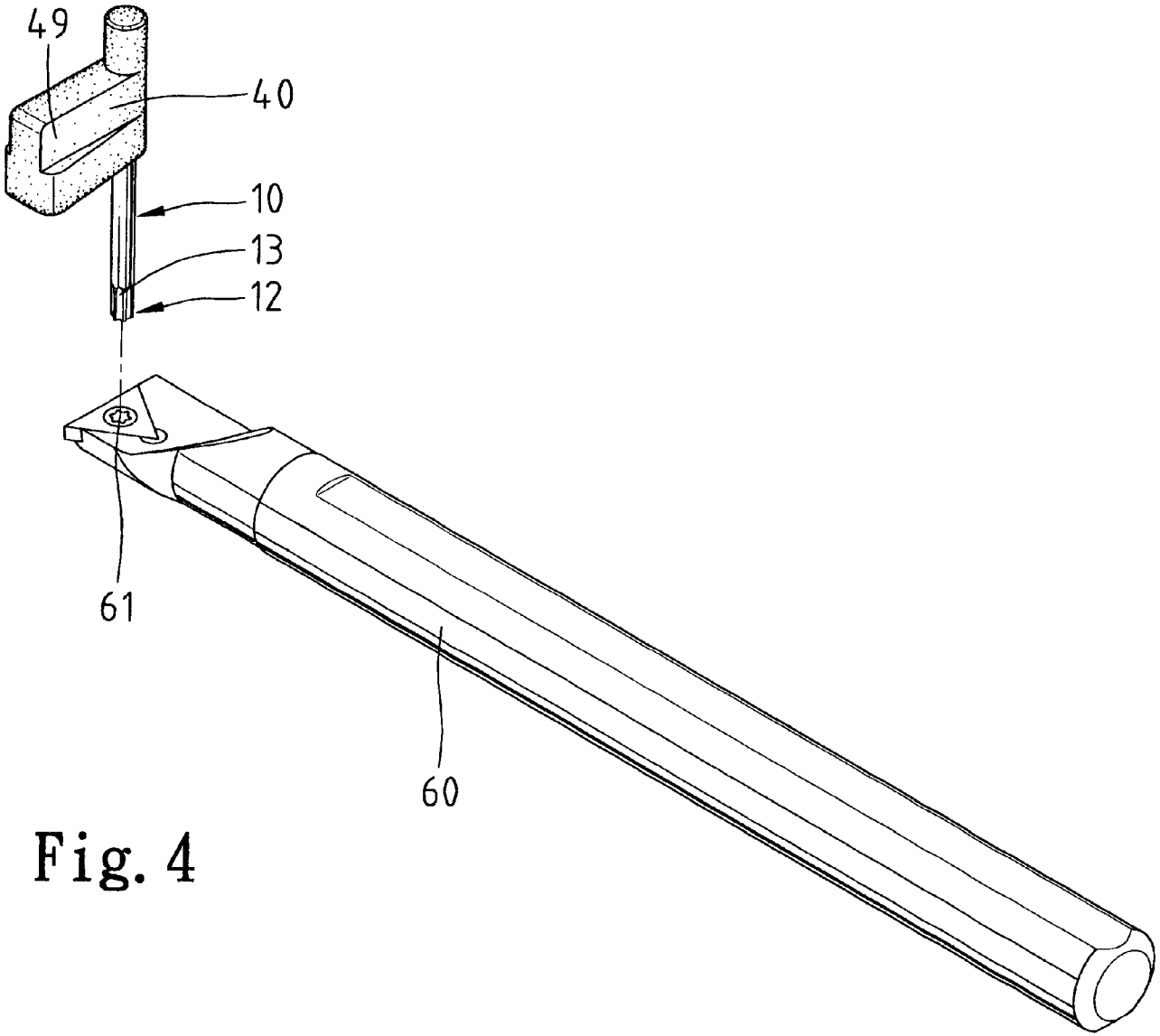
FIG. 4 is a perspective view illustrating use of the wrench in accordance with the present invention.
Figure 6:
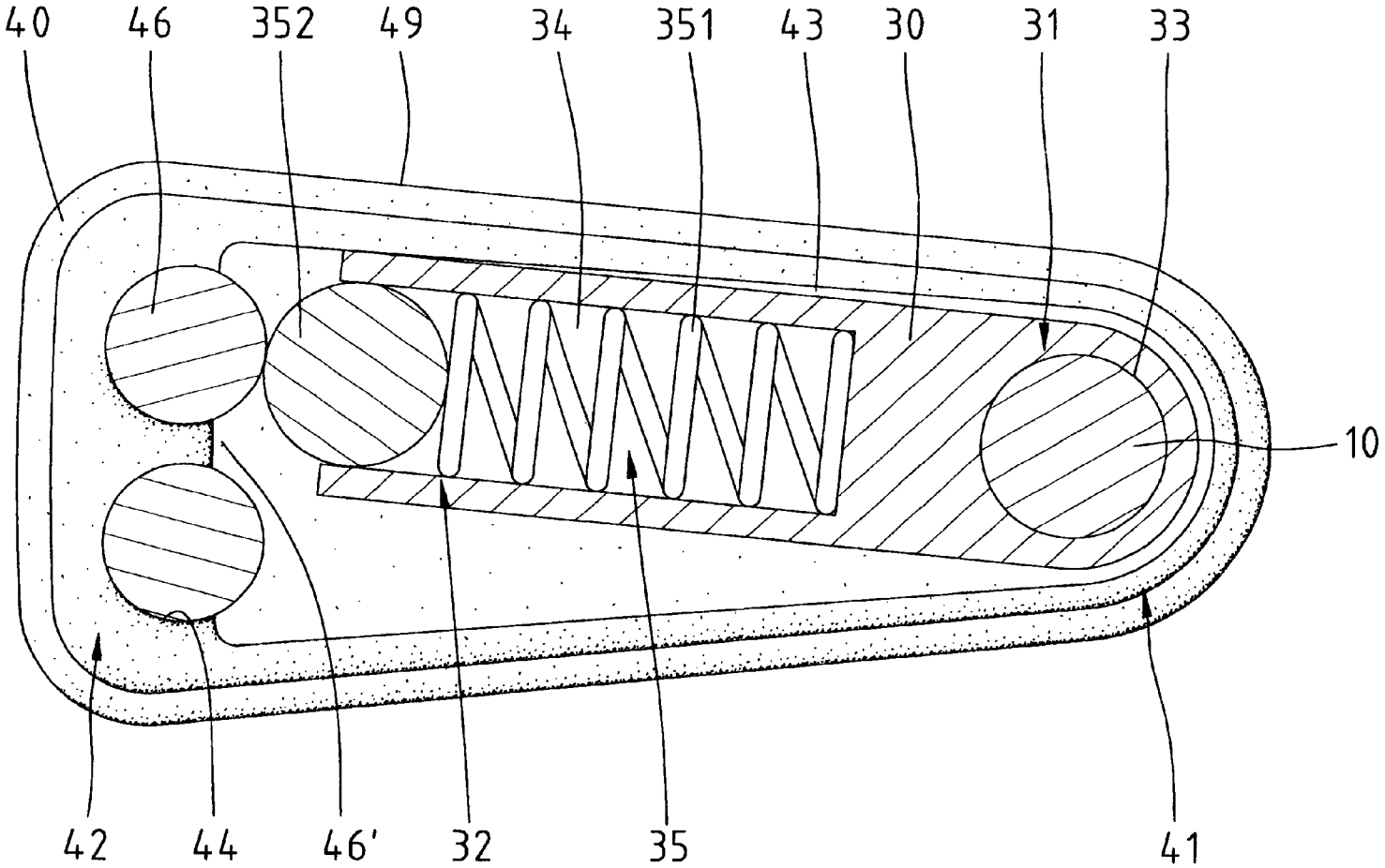
FIG. 6 is a sectional view similar to FIG. 5, illustrating operation of the wrench in a direction.
Figure 7:
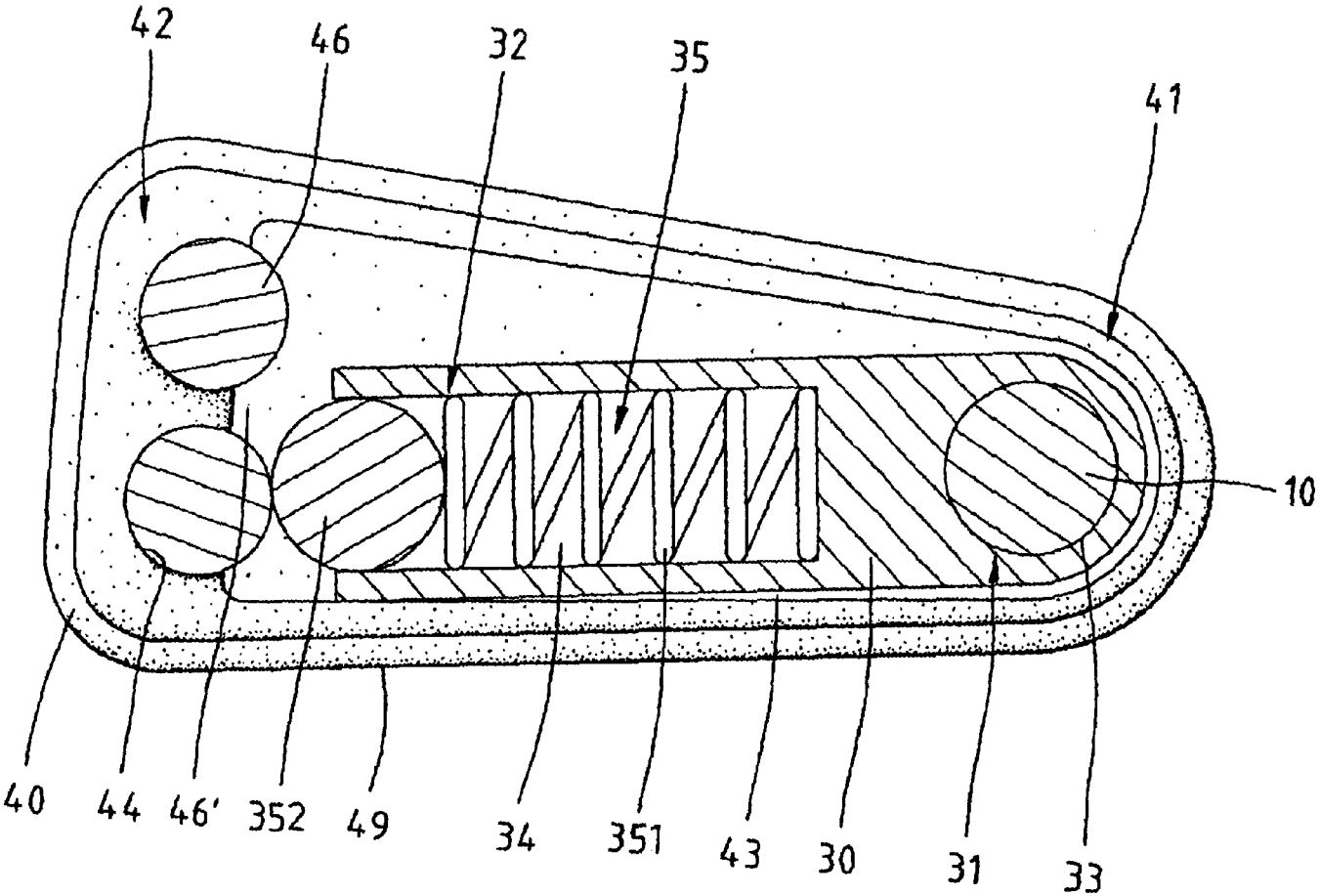
FIG. 7 is a sectional view similar to FIG. 5, illustrating operation of the wrench in a different direction.

Referring to FIG. 4, when driving a TROX type bolt 61 for a cutting tool 60, the driving portion 13 of the second end 12 of the rod 10 is engaged with the bolt 61, and the casing 40 is then turned by means of gripping and turning the grip portion 49. Referring to FIG. 5, when the rotational force applied to the wrench is smaller than a predetermined engaging force between the ball 352 and the steel pegs 46, the retainer 30 and the rod 10 turn together with the casing 40 to thereby drive the bolt 61. When the rotational force applied to the wrench is greater than the predetermined engaging force between the ball 352 and the steel pegs 46, the casing 40 slides relative to the ball 352. Thus, the casing 40 is moved to a position shown in FIG. 6 or FIG. 7; namely, the ball 352 is disengaged from the retaining space 46', but the retainer 30 and the rod 10 are not turned. As a result, the bolt 61 is not turned. The casing 40 returns to its original position shown in FIG. 5 under the action of the elastic element 351 when the force is released.

It is noted that the engaging force, which largely depends on the elastic coefficient of the elastic element 351, determines a maximum operational torque for turning the retainer 30 and the rod 10. Namely, when the torque applied to the casing 40 is smaller than the maximum operational torque, the retainer 30 and the rod 10 are turned, and when the torque applied to the casing 40 is greater than the maximum operational torque, the retainer 30 and the rod 10 are not turned. During tightening of the bolt 61, the bolt 61 before being tightened is turned by means of applying a torque smaller than the maximum operational torque. When the bolt 61 is tightened, the torque required to turn the casing 40 would be greater than the maximum operational torque such that the casing 40 slides. Thus, the user will notice the sliding motion of the casing 40 and be aware of tightening of the bolt 61. The maximum operational torque can be altered by means of selecting elastic elements of different elastic coefficients.

Figure 8:
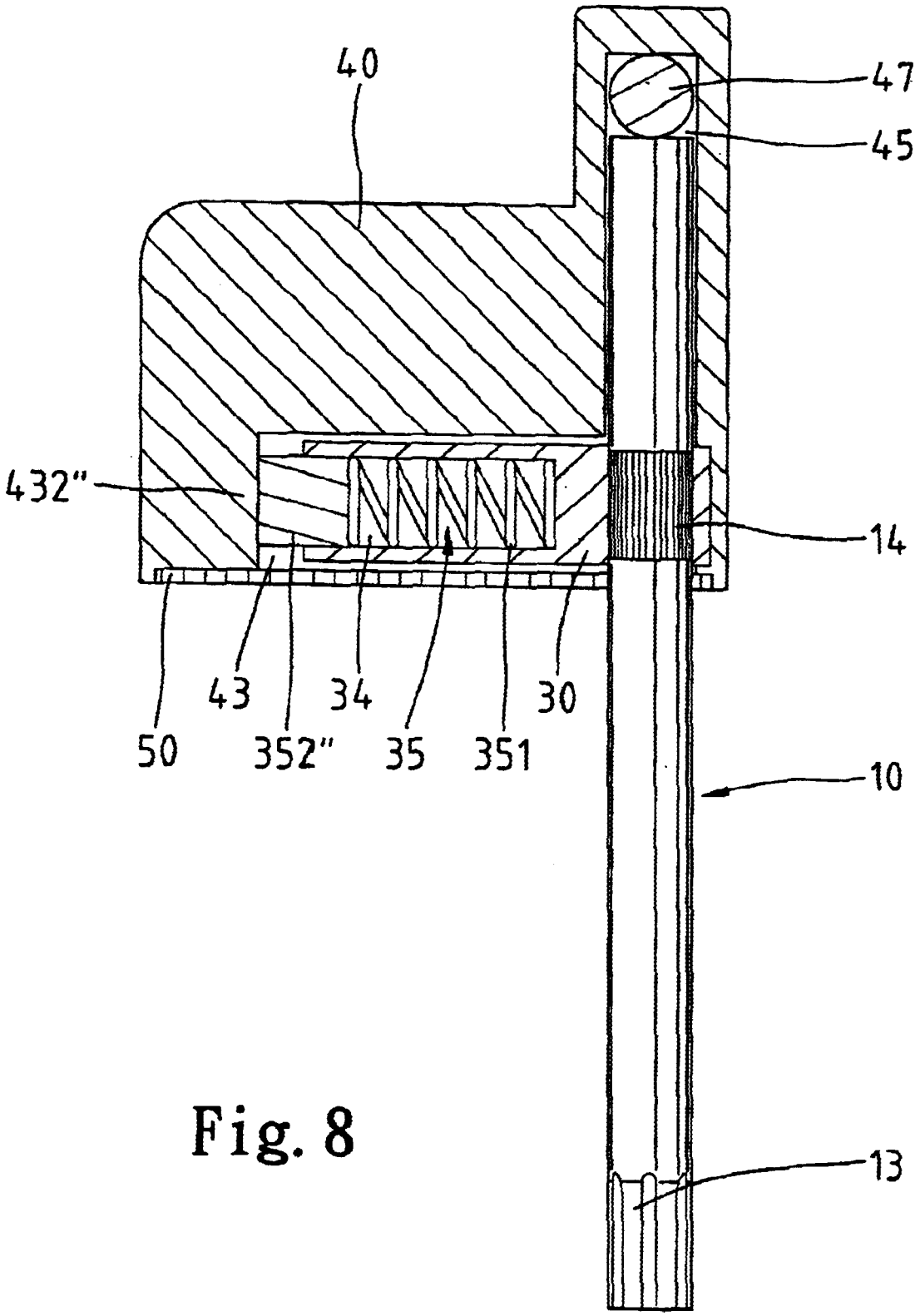
FIG. 8 is a sectional view similar to FIG. 3, illustrating a modified embodiment of the wrench in accordance with the present invention.
Figure 9:
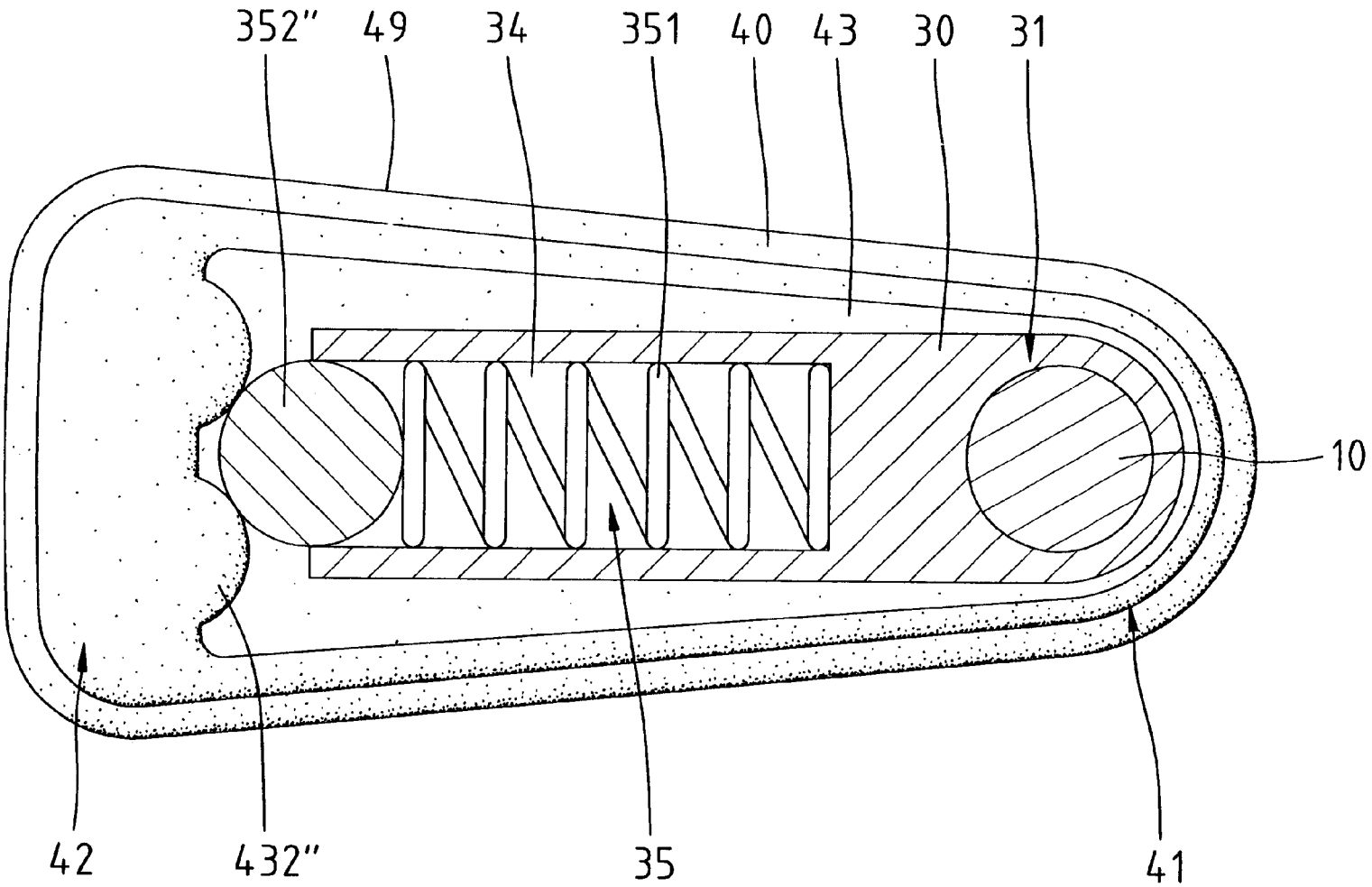
FIG. 9 is a sectional view similar to FIG. 5, illustrating the modified embodiment of the wrench in accordance with the present invention.
Figure 10A:
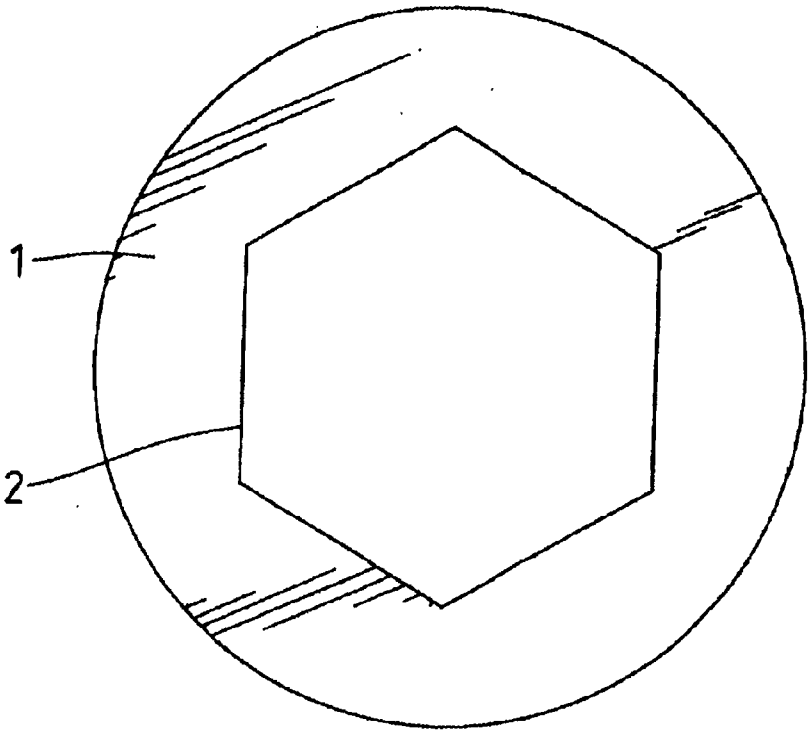
Fig. 10A PRIOR ART
FIG. 10A is an end view of a conventional hexagonal wrench.
Figure 10B:
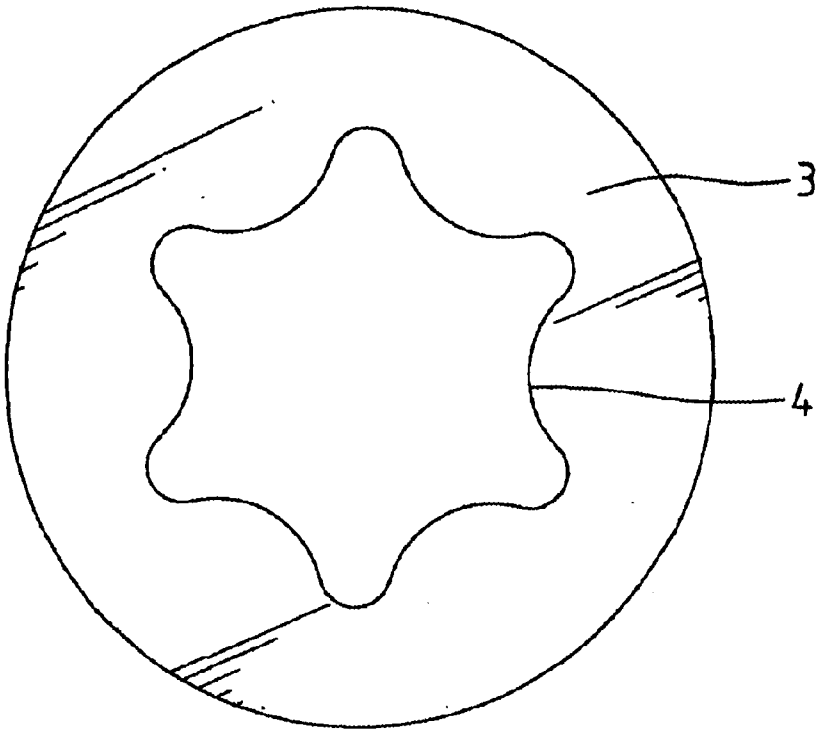
Fig. 10B PRIOR ART
FIG. 10B is an end view of a conventional TROX wrench.
Figure 11:
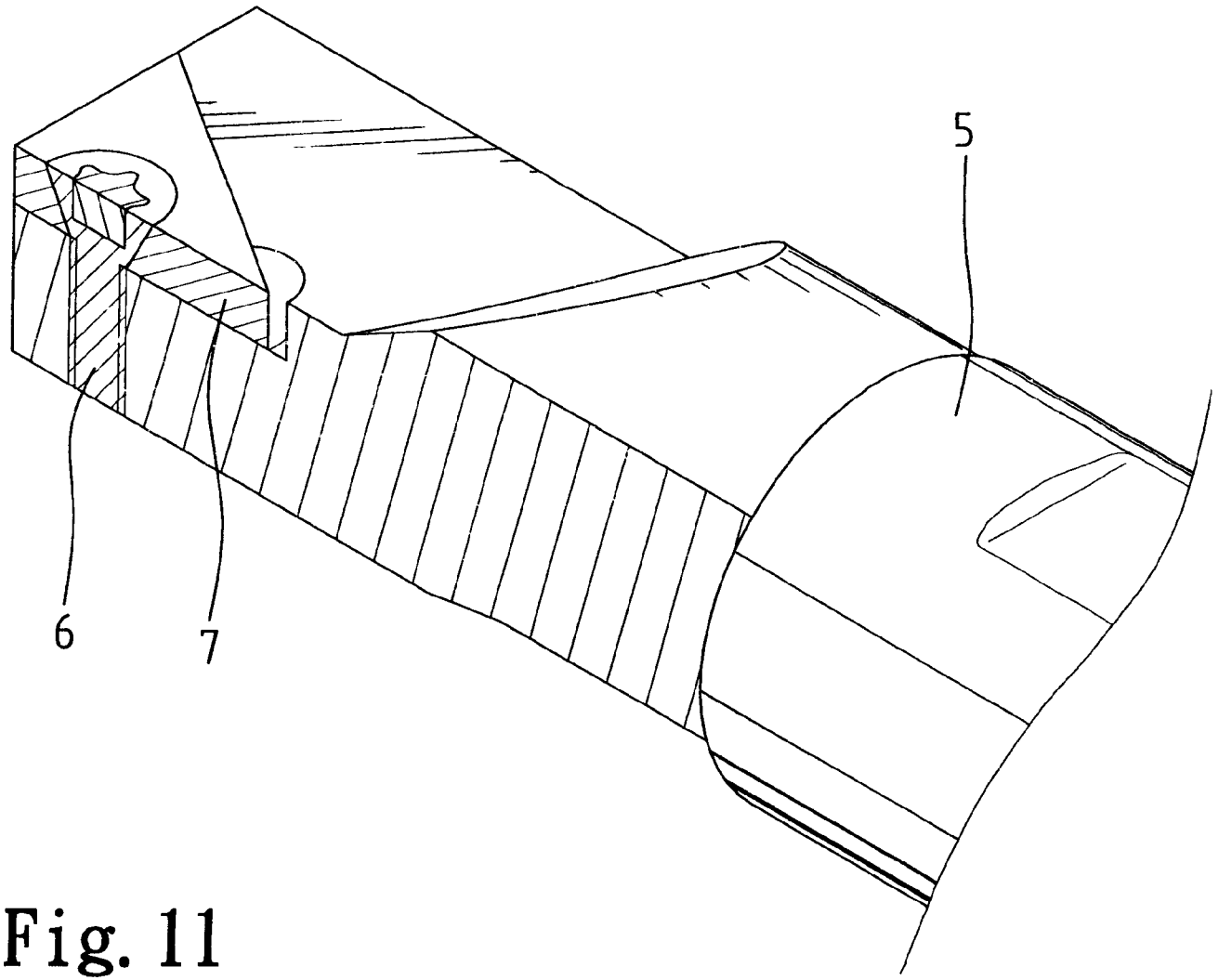
Fig. 11 PRIOR ART
FIG. 11 is a perspective view, partly cutaway, of a cutting tool.

FIGS. 8 and 9 illustrate a modified embodiment of the invention, wherein the steel pegs 46 forming the retaining section are replaced by two protrusions 432" that are integrally formed with the wall defining the portion of the compartment 43 of the casing 40. Thus, the protrusions 432" and the casing 40 can be made by means of injection molding. In addition, the ball 352 is replaced by a cylinder 352" that can also be made of plastic material.

Although the invention has been explained in relation to its preferred embodiment, it is to be understood that many other possible modifications and variations can be made without departing from the scope of the invention as hereinafter claimed.

What is claimed is:

1. A wrench comprising:

a rod comprising a driving portion on an end thereof for engaging with a fastener;

a retainer having a first end securely engaged with the rod to move therewith and a second end;

a casing comprising a compartment for accommodating the retainer, the casing comprising a retaining section defining a retaining space for retaining the second end of the retainer in place, wherein the retaining section of the compartment of the casing comprises two peg holes each having a peg anchored therein, each said peg being partially exposed in the compartment to thereby define the retaining space between exposed portions of the pegs; and means for retaining the retainer in place, the retaining means having a first end attached to the second end of the retainer and a second end retained in the retaining space;

wherein when a rotational force applied to the casing is smaller than an engaging force between the retaining section of the casing and the second end of the retaining means, the retainer and the rod are turned to thereby turn the fastener; and wherein when a rotational force applied to the casing is greater than the engaging force between the retaining section of the casing and the second end of the retaining means, the casing slides while the retainer and the rod are not turned.

2. The wrench as claimed in claim 1, wherein the exposed portion of each said peg is smaller than a half of said peg.

3. The wrench as claimed in claim 1, wherein the first end of the retainer has a transverse through-hole through which the rod extends.

4. The wrench as claimed in claim 3, wherein the rod comprises an embossed section that is securely engaged in the transverse through-hole of the retainer.

5. The wrench as claimed in claim 1, with the retaining means comprising an elastic element and a ball, wherein the second end of the retainer comprises a receptacle for receiving the elastic element and the ball, the ball being biased by the elastic element into the retaining space between the exposed portions of the pegs.

6. The wrench as claimed in claim 1, further comprising a lid for enclosing the compartment of the casing.

7. The wrench as claimed in claim 1, with the retaining means comprising an elastic element and a cylinder, wherein the second end of the retainer comprises a receptacle for receiving the elastic element and the cylinder, the cylinder being biased by the elastic element into the retaining space between the exposed portion of the pegs.

8. A wrench comprising:

a rod comprising a driving portion on an end thereof for engaging with a fastener;

a member securely engaged with the rod to move therewith;

a casing comprising a compartment for accommodating the member;

means for retaining the member in place relative to the casing, the retaining means having an engaging force between the member and the casing, with the casing comprising a section defining a space where the retaining means is located; and a lid for enclosing the compartment of the casing, wherein the lid comprises a hole through which the rod extends;

wherein when a rotational force applied to the casing is smaller than the engaging force, the retainer and the rod are turned to thereby turn the fastener; and wherein when a rotational force applied to the casing is greater than the engaging force, the casing slides while the retainer and the rod are not turned.

9. The wrench as claimed in claim 8, with the member comprising a retainer having a first end securely engaged with the rod to move therewith and a second end, with the compartment accommodating the retainer, the space defining a retaining space for retaining the second end of the retainer in place, with the retaining means having a first end attached to the second end of the retainer and a second end retained in the retaining space;

wherein when the rotational force applied to the casing is smaller than the engaging force between the section of the casing and the second end of the retaining means, the retainer and the rod are turned to thereby turn the fastener; and wherein when the rotational force applied to the casing is greater than the engaging force between the section of the casing and the second end of the retaining means, the casing slides while the retainer and the rod are not turned.

10. The wrench as claimed in claim 9, wherein the section of the casing comprises two spaced protrusions that are formed on a wall defining a portion of the compartment.

11. The wrench as claimed in claim 10, with the retaining means comprising an elastic element and a cylinder, wherein the second end of the retainer comprises a receptacle for receiving the elastic element and the cylinder, the cylinder being biased by the elastic element into the retaining space between the protrusions.

12. The wrench as claimed in claim 1, wherein the casing comprises a recessed portion surrounding the compartment, further comprising a lid mounted in the recessed portion for enclosing the compartment.

13. The wrench as claimed in claim 12, wherein the lid comprises a hole through which the rod extends.

14. The wrench as claimed in claim 1, wherein the casing comprises a positioning hole for receiving another end of the rod.

15. The wrench as claimed in claim 14, further comprising a ball mounted between an end face of said another end of the rod and an end wall defining a portion of the positioning hole.

16. The wrench as claimed in claim 1, wherein the casing comprises a grip portion.

17. The wrench as claimed in claim 8, wherein the casing comprises a recessed portion surrounding the compartment, with the lid mounted in the recessed portion.

18. The wrench as claimed in claim 9, wherein the first end of the retainer has a transverse through-hole through which the rod extends.

19. The wrench as claimed in claim 18, wherein the rod comprises an embossed section that is securely engaged in the transverse through-hole of the retainer.

20. The wrench as claimed in claim 9, with the retaining means comprising an elastic element and a ball, wherein the second end of the retainer comprises a receptacle for receiving the elastic element and the ball, the ball being biased by the elastic element into the retaining space.

* * * * *